US009150042B2

(12) United States Patent
Chiang

(10) Patent No.: US 9,150,042 B2
(45) Date of Patent: Oct. 6, 2015

(54) FULLY AUTOMATIC COIL BINDING MACHINE

(71) Applicant: Chung Sheen Technology Co., Ltd, Taichung (TW)

(72) Inventor: Chou-Chih Chiang, Taichung (TW)

(73) Assignee: CHUNG SHEEN TECHNOLOGY CO., LTD, Taichung (TW)

( * ) Notice: Subject to any disclaimer, the term of this patent is extended or adjusted under 35 U.S.C. 154(b) by 314 days.

(21) Appl. No.: 13/828,255

(22) Filed: Mar. 14, 2013

(65) Prior Publication Data

US 2014/0271041 A1 Sep. 18, 2014

(51) Int. Cl.
*B42B 5/12* (2006.01)

(52) U.S. Cl.
CPC ..... *B42B 5/126* (2013.01)

(58) Field of Classification Search
CPC ..... B21F 3/04; B21F 45/16; B45B 5/12; B45B 5/123; B45B 5/126
USPC ..... 412/10, 11, 16, 33, 39, 40; 140/92.3
See application file for complete search history.

(56) References Cited

U.S. PATENT DOCUMENTS

| | | | | |
|---|---|---|---|---|
| 5,890,862 | A * | 4/1999 | Spiel et al. | 412/40 |
| 5,934,340 | A * | 8/1999 | Anthony et al. | 140/92.94 |
| 6,000,897 | A * | 12/1999 | DesJarlais | 412/40 |
| 6,773,216 | B2 * | 8/2004 | Crudo et al. | 412/39 |

* cited by examiner

*Primary Examiner* — Edward Tolan
(74) *Attorney, Agent, or Firm* — Chun-Ming Shih

(57) ABSTRACT

A fully automatic coil binding machine includes a main body, a width adjusting device, a paper clamping device, a resting device, a coil driving device, a cutting device and a driving device. The main body has a coil guiding slot and a guiding row of teeth. The width adjusting device may be used to adjust the width of the coil guiding slot. The paper clamping device has a paper slot, in which a stack of paper may be placed. The binding edge of the stack of paper may rest on the resting device, so that its curvature may be adjusted. The coil driving device may move the coil located in the coil guiding slot along the guiding row of teeth into the paper slot and drive the coil to spin through the holes of the stack of paper.

2 Claims, 19 Drawing Sheets

FULLY AUTOMATIC COIL BINDING MACHINE

BACKGROUND OF THE INVENTION

1. Field of the Invention

The invention generally relates to a coil binding machine. More particularly, the invention relates to a fully automatic coil binding machine.

2. Description of the Prior Art

In the regular coil binding process, first, a row of holes are punched in a stack of paper and then a coil is inserted through the holes. Last, the two ends of the coil are cut up.

As of now, there are two methods to carry out coil binding process: by pure manual labor and by machine. If it is carried out by pure manual labor, such method takes too much time and manpower and hence can not be used to carry out the binding for a large amount of books. Therefore, machine must be used to carry out the binding of a large amount of books. However, in the binding process by machine, the coil can not spin through the holes smoothly because the holes are not oriented at appropriate angle and curvature; therefore, such angle and curvature have to be manually formed at the binding edge before the coil spin through the holes, lowering the speed in the binding process and often resulting in inaccuracy in such angle and curvature.

SUMMARY OF THE INVENTION

A first object of the present invention is to provide a fully automatic coil binding machine that enables fast binding process and hence is suitable to be used for the binding of large amount of books.

A second object of the present invention is to provide a fully automatic coil binding machine that operates more smoothly in binding process.

A third object of the present invention is to provide a fully automatic coil binding machine that is characterized with the saving of manpower and time as well as a higher efficiency in binding process.

To realize the above purposes, the present invention of fully automatic coil binding machine comprises:

A main body, having a coil guiding slot and a guiding row of teeth provided in the slot;

A width adjusting device, disposed by the coil guiding slot and able to be driven to move reciprocally to adjust the width of the coil guiding slot;

A paper clamping device, disposed on the right hand side of the main body and having an inner plate unit, an outer plate unit, at least a paper clamping motor and a tilting angle adjusting unit, wherein the inner plate unit is fixed on the main body and the outer plate unit is disposed on an outer side with respect to the inner plate unit and is connected with a paper clamping motor, so that the former moves in sync with the latter, characterized in that the outer plate unit may be moved reciprocally between a paper clamping position and a paper releasing position, that when the outer plate unit is at the paper releasing position, a paper slot, which is aligned with and in communication with the coil guiding slot, is formed between the outer plate unit and the inner plate unit, so that a stack of paper may be held in the paper slot, and characterized in that a tilting angle adjusting unit is disposed on a side of the paper slot to adjust the tilting angle of the stack of paper;

A resting device, disposed inside the main body and may be driven to reciprocally move between a resting position and a detachment position, characterized in that when the resting device is at the resting position, the stack of paper placed in the paper slot may rest against the resting device, so as to form a curvature on the binding edge of the stack of paper;

A coil driving device, disposed behind the coil guiding slot and near the width adjusting device and able to move the coil along the guiding row of teeth to enter the paper slot, so that the coil may spin through the punched holes of the stack of paper; and A cutting device, disposed on the main body and may be driven by an external force to reciprocally move between a cutting position and a preparatory position, characterized in that when the cutting device is at its cutting position, it may cut up the two ends of the coil.

BRIEF DESCRIPTION OF THE DRAWINGS

The drawings disclose an illustrative embodiment of the present invention which serves to exemplify the various advantages and objects hereof, and are as follows:

FIG. 1 is a perspective view showing the fully automatic coil binding machine of the present invention.

DETAILED DESCRIPTION OF THE PREFERRED EMBODIMENT

Figure 1C:
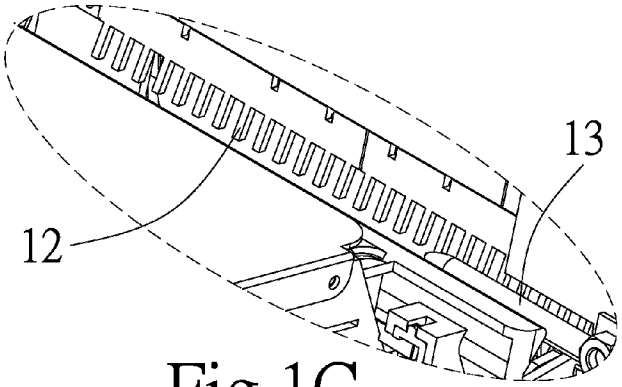
FIG. 1C is a partially enlarged view of part "C", showing the guiding row of teeth and the coil guiding unit.

The fully automatic coil binding machine of the present invention comprises a main body 1, a width adjusting device 14, a paper clamping device 2, a resting device 3, a coil driving device 4, a cutting device 5 and a driving device 6.

Figure 1A:
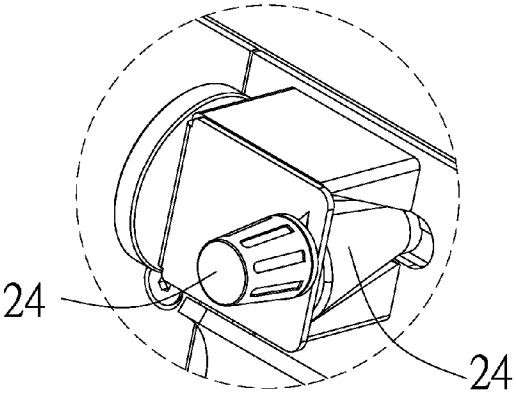
FIG. 1A is a partially enlarged view of part "A", showing the tilting angle adjusting unit.
Figure 1B:
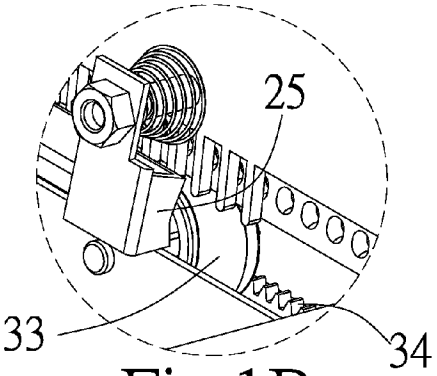
FIG. 1B is a partially enlarged view of part "B", showing the passive curvature forming unit and the row of teeth.
Figure 2:
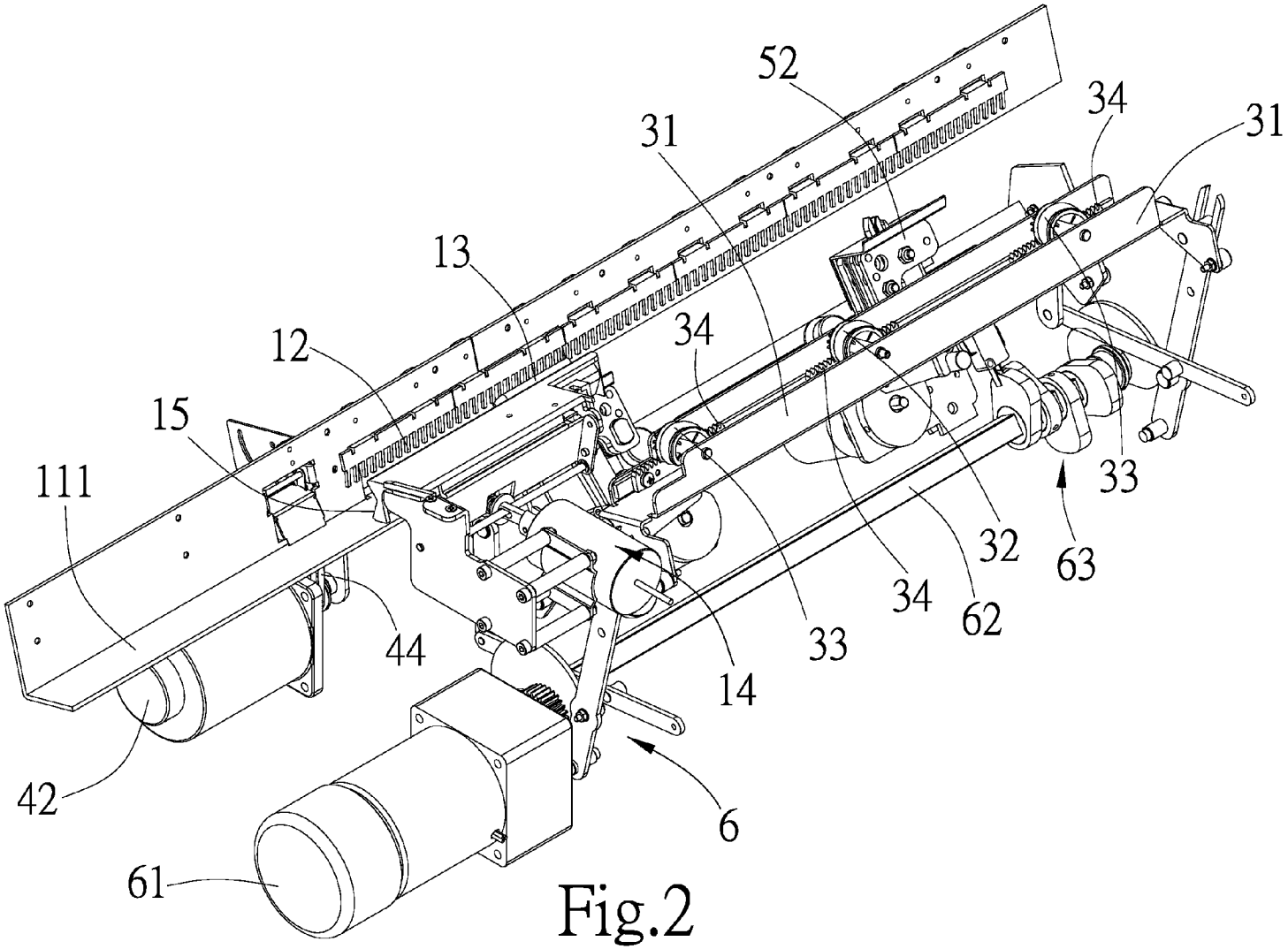
FIGS. 2 and 3 are two views illustrating the main body, resting device and driving device.
Figure 3:
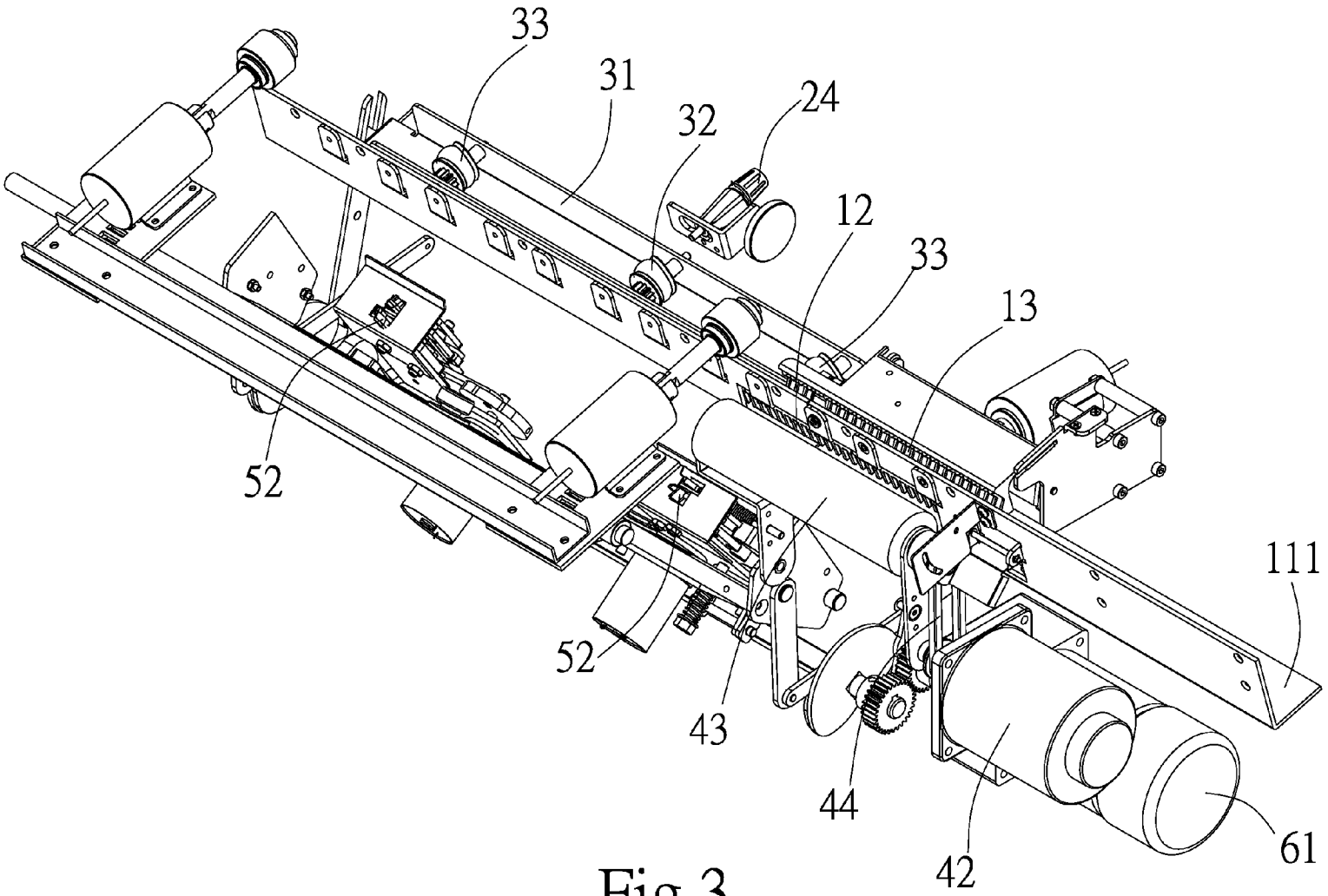
Figure 4:
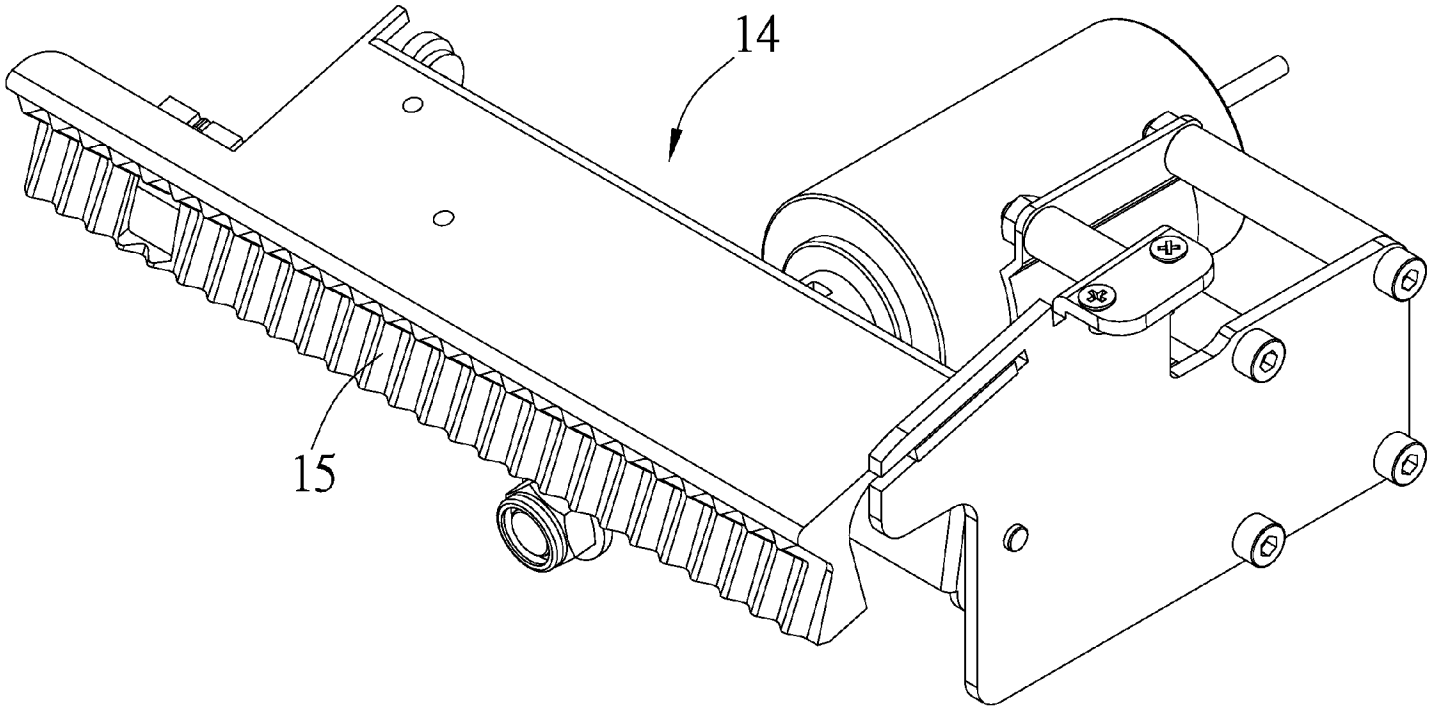
FIG. 4 is a view illustrating the width adjusting device mounted on the main body.
Figure 5:
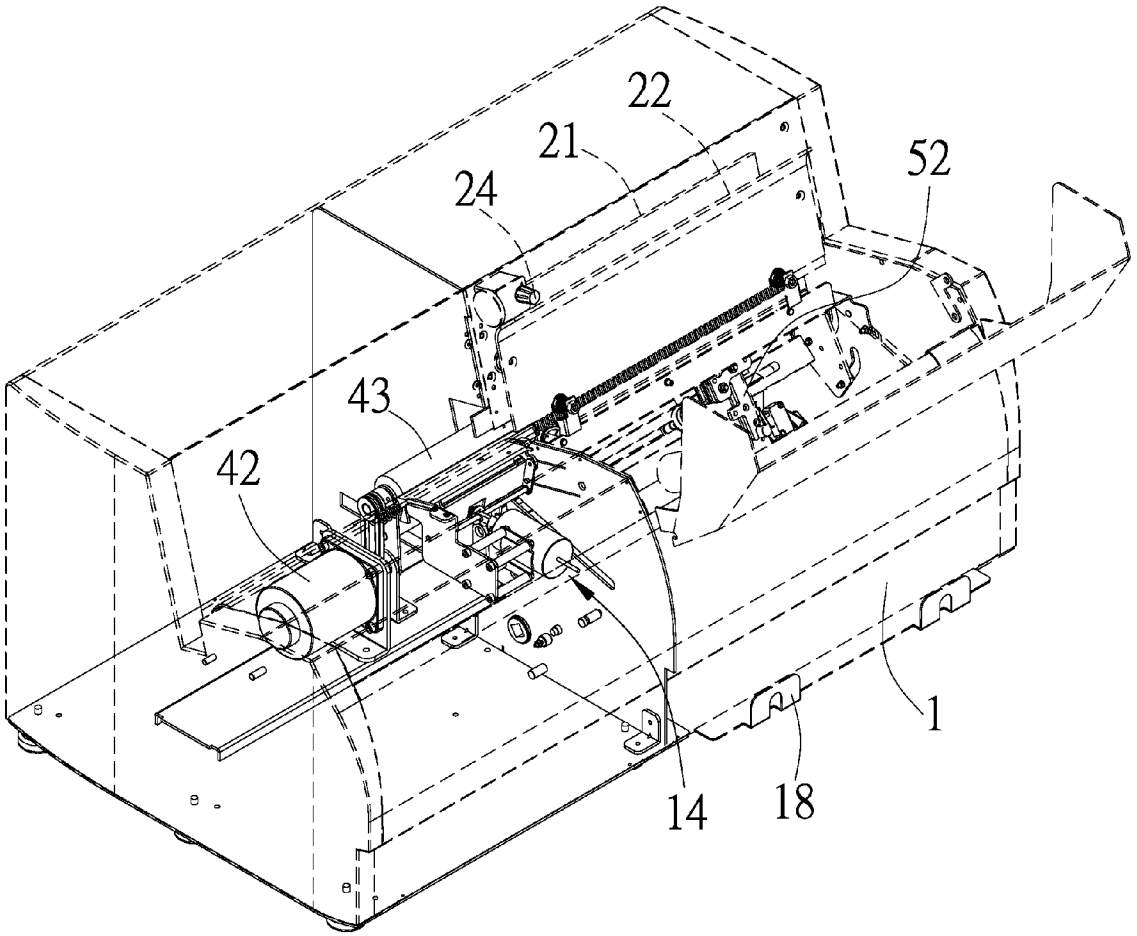
FIGS. 5 and 6 are two views illustrating the coil driving device.
Figure 6A:
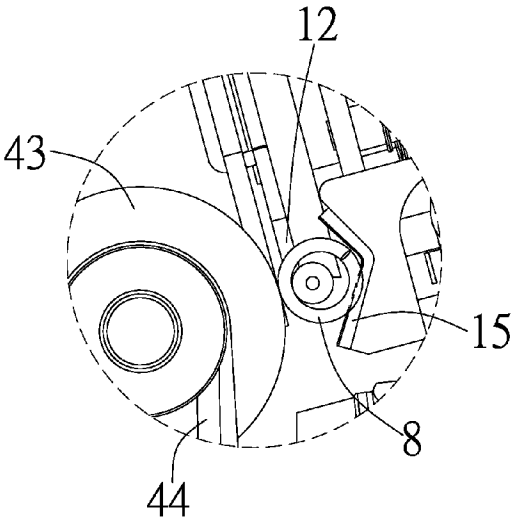
FIG. 6A is a partially enlarged view of part "A" in FIG. 6, showing the spatial relationship between the guiding row of teeth, guiding slot, friction roller and coil.
Figure 6:
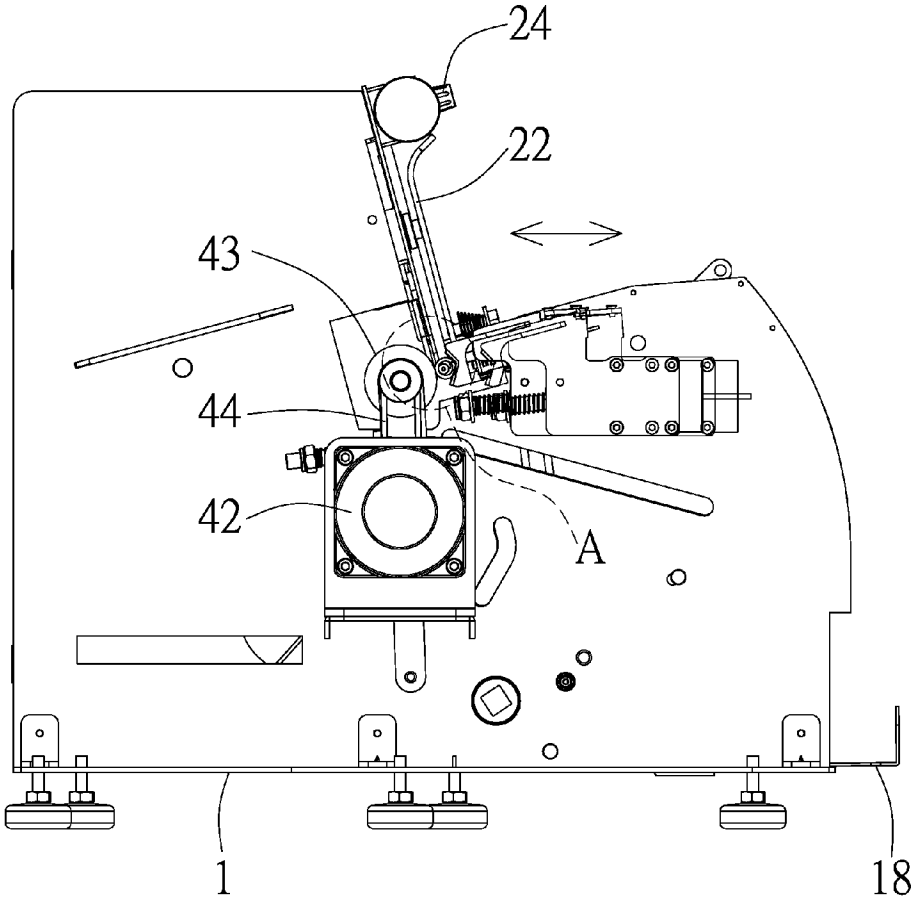
Figure 7:
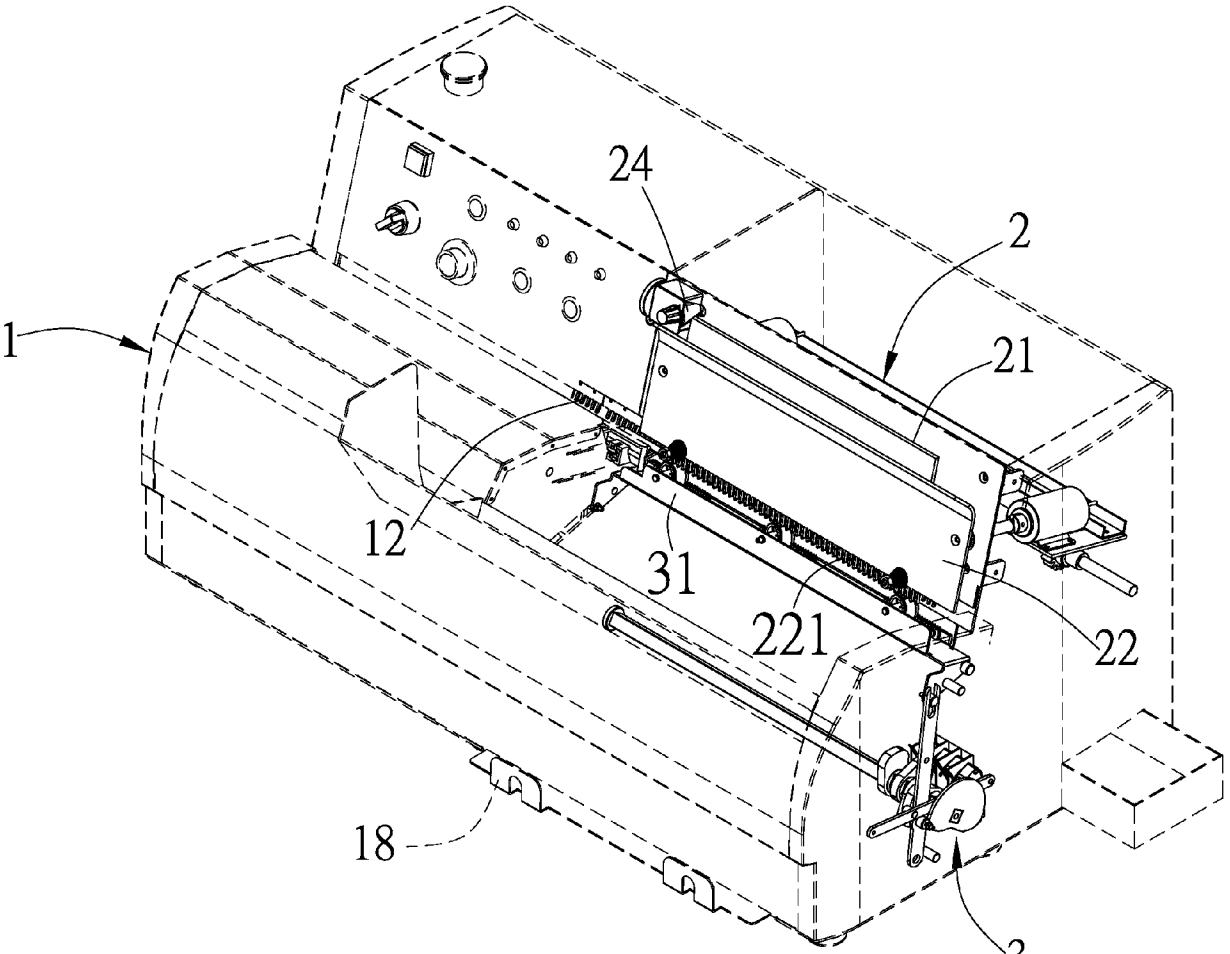
FIG. 7 is a perspective view showing the paper clamping device and the resting device.
Figure 8:
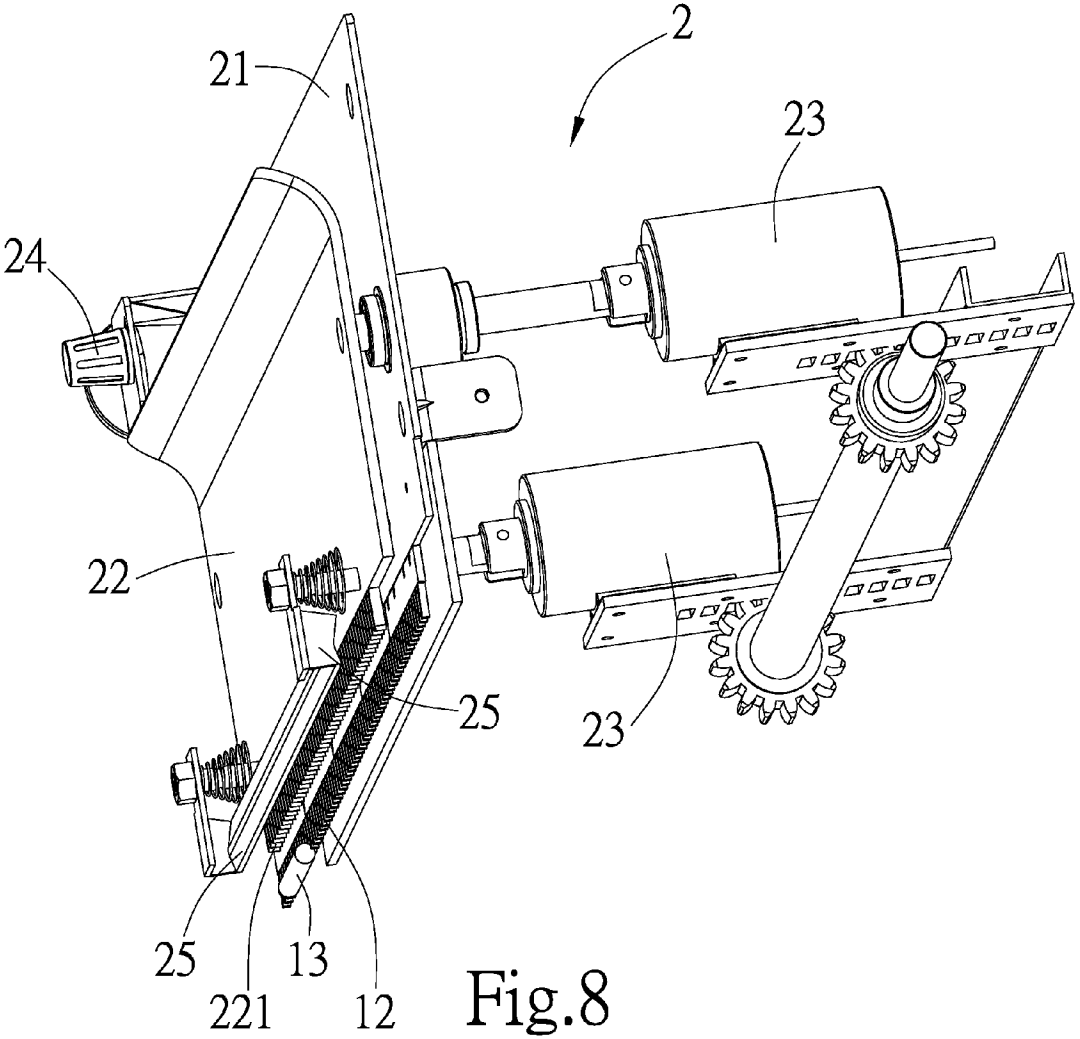
FIG. 8 is a perspective view showing the lower portion of the paper clamping device.
Figure 9A:
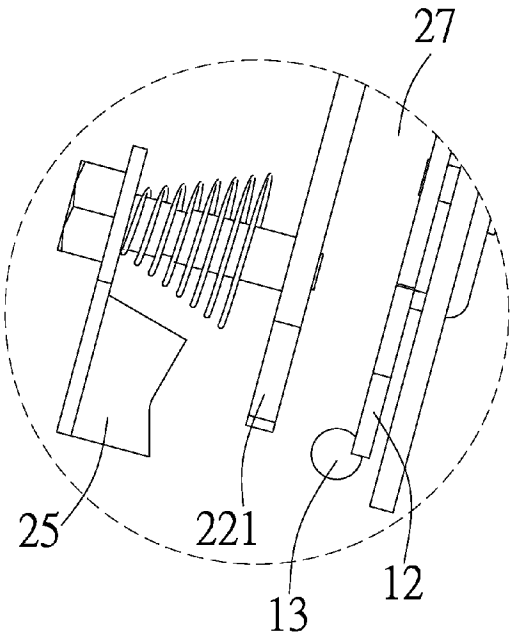
FIG. 9A is a partially enlarged view of part "A" in FIG. 9.
Figure 9:
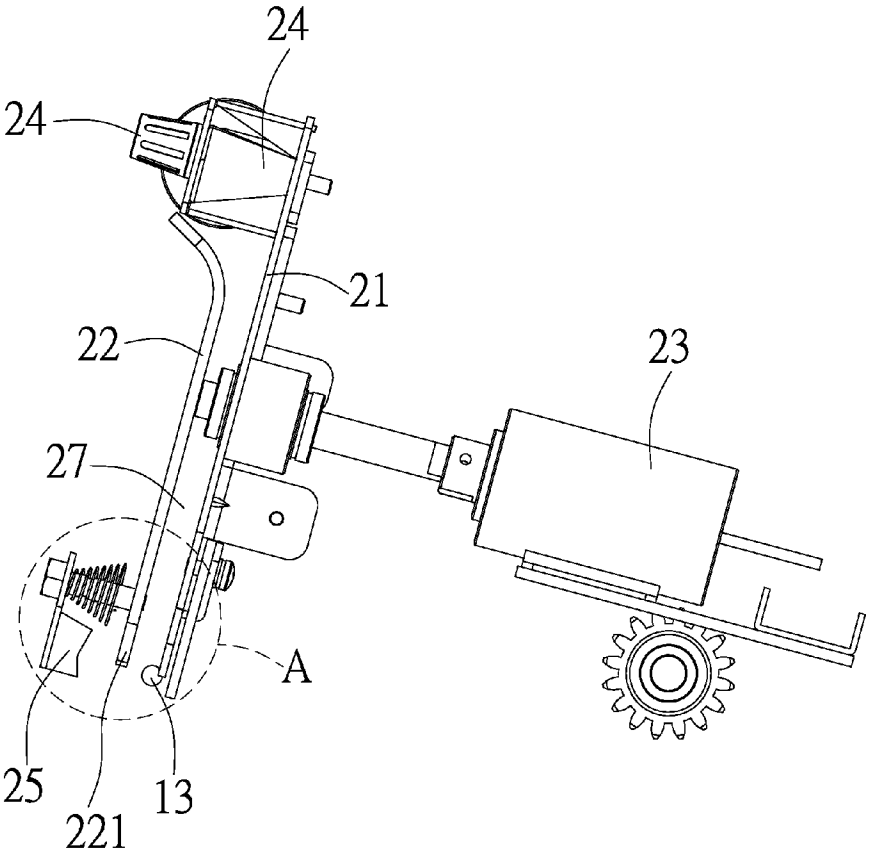
FIG. 9 is a side view of the paper clamping device.
Figure 10:
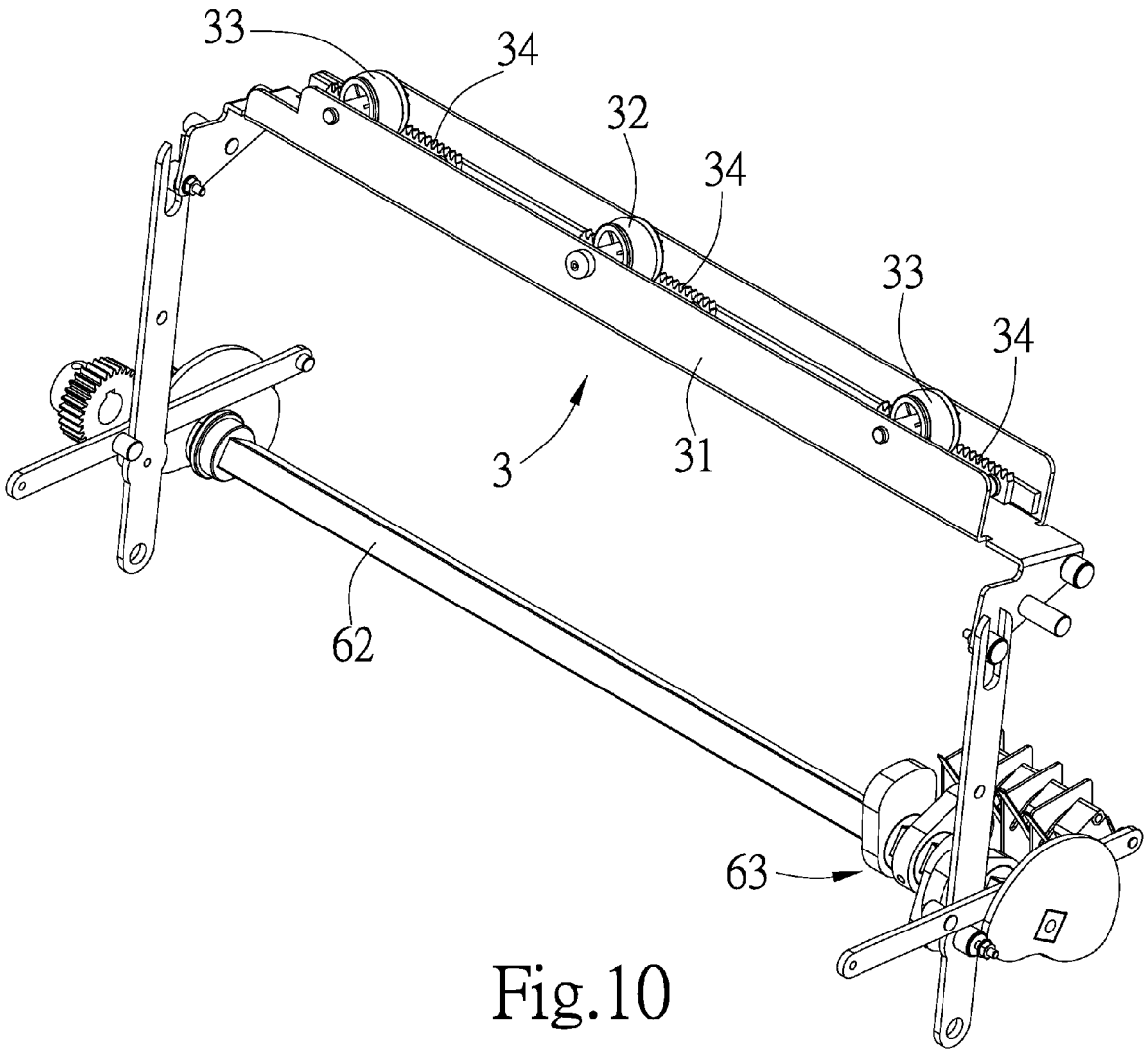
FIG. 10 is a perspective view showing the resting device and the driving device.
Figure 11:
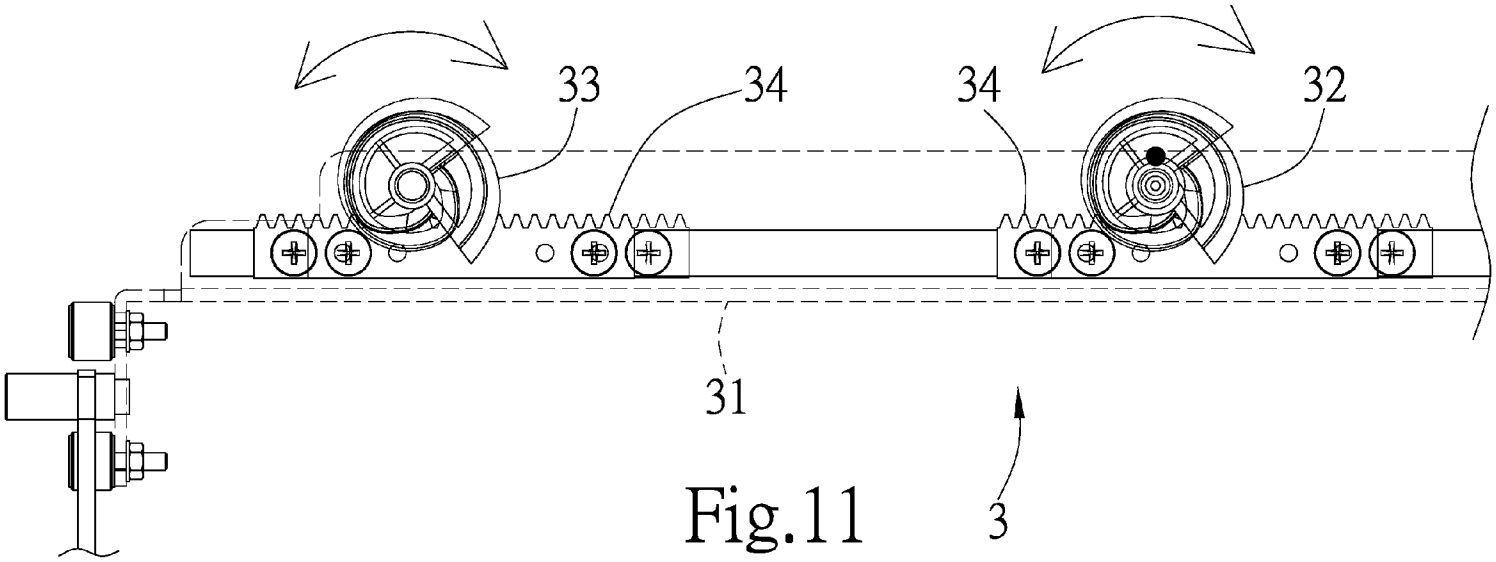
FIGS. 11 and 12 are two views illustrating the resting device.
Figure 12:
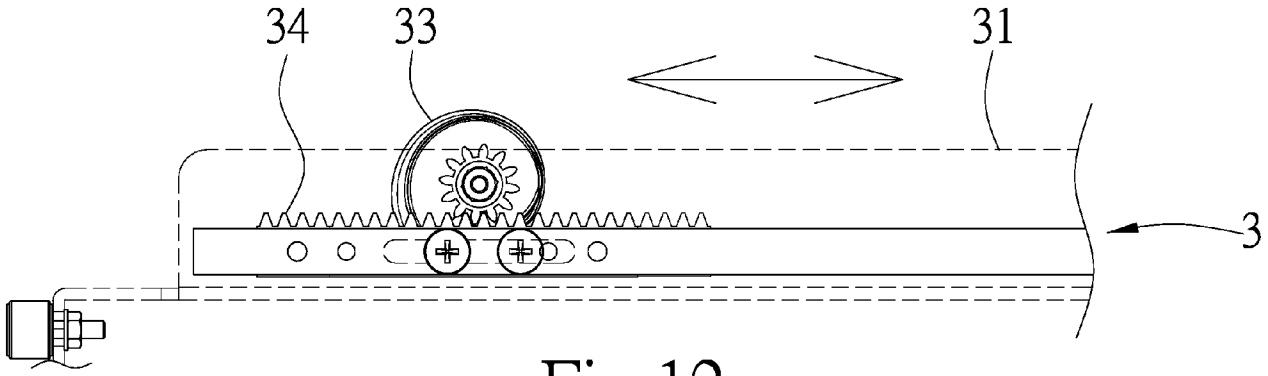

Please refer to FIGS. 1 to 3. A coil guiding slot 11 is centrally provided in the main body 1 and has a bottom portion 111. A guiding row of teeth 12 is provided in the slot 11. A coil guiding unit 13 is disposed by the guiding row of teeth 12 to spin the coil 8 through the holes of a stack of paper 7. A width adjusting device 14 is provided on the left front side of the guiding slot 11 and at a position opposing to the guiding row of teeth 12 (as illustrated in FIG. 1C). The width adjusting device 14 has a guiding slot 15 facing the guiding row of teeth 12. Because the width adjusting device 14 can be driven to move reciprocally to adjust the distance between the guiding slot 15 and the bottom portion 111 (as illustrated in FIG. 4). A collecting container 16 is detachably connected to the main body 1 under the paper slot 27. A control panel is electrically connected with these components and can control them.

Now, please refer to FIGS. 5 to 9. A paper clamping device 2 is disposed on the right hand side of the main body 1. The paper clamping device 2 has an inner plate unit 21, an outer plate unit 22, at least a paper clamping motor 23, a tilting angle adjusting unit 24 (as illustrated in FIG. 1A), a guiding element 25 and a rear plate unit 26. The outer plate unit 22 has a row of teeth 221. The inner plate unit 21 is fixed on the main body 1 and is connected with the guiding row of teeth 12. The outer plate unit 22 is disposed on an outer side with respect to the inner plate unit 21 and is connected with a paper clamping motor 23, so that the former moves in sync with the latter. When the paper clamping motor 23 is activated, the outer plate unit 22 and the guiding element 25 are moved reciprocally between a paper clamping position and a paper releasing position. When they are at the paper releasing position, a paper slot, which is aligned with and in communication with the coil guiding slot 11, is formed between the outer plate unit 22 and the inner plate unit 21. The tilting angle adjusting unit 24 comprises a cam, which is mounted on the inner plate unit 21. The tilting angle adjusting unit 24 may be manually rotated by a user.

Figure 13B:
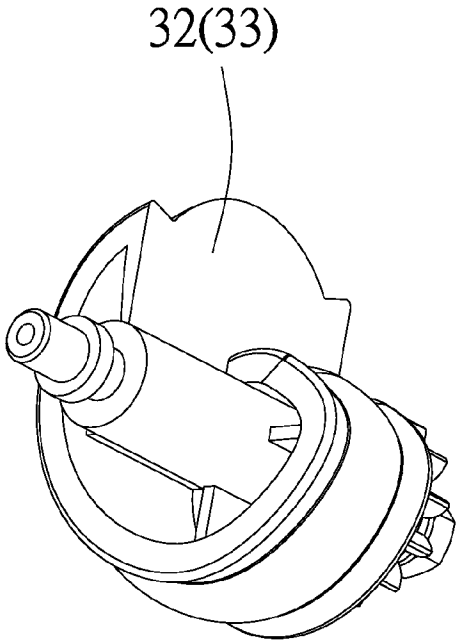
FIGS. 13A and 13B are enlarged perspective views showing the curvature forming unit (the passive curvature forming unit).
Figure 13A:
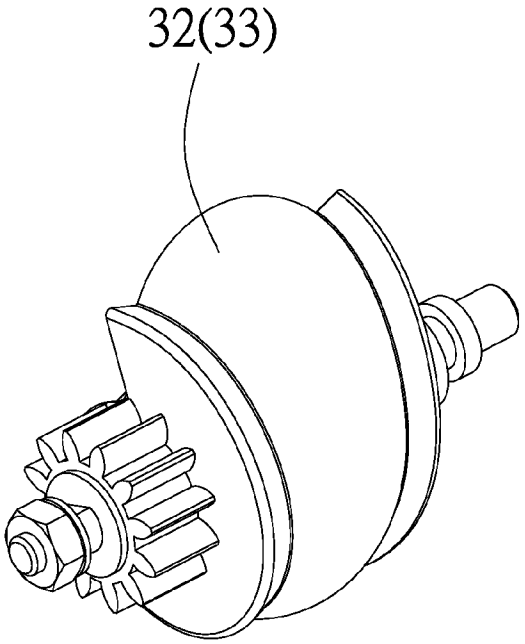

Now, please refer to FIGS. 1B, 7, 10, 11 and 12. The resting device 3 is disposed near a rear portion of the guiding row of teeth, so that the stack of paper 7 placed in the paper slot 27 may rest against the resting device 3. The resting device 3 has a moveable framework 31, an active curvature forming unit 32, two passive curvature forming units 33 and a row of teeth 34. The moveable framework 31 is disposed inside the main body 1 and may be driven to reciprocally move between a resting position and a detachment position, as illustrated in FIG. 13. Either the active curvature forming unit 32 or the passive curvature forming unit 33 comprises a cam and the active and passive curvature forming units 32 and 33 are pivotally mounted on the moveable framework 31. The row of teeth 34 is mounted on the moveable framework 31 and able to move along the latter. In addition, because the row of teeth 34 engages with the active curvature forming unit 32 and two passive curvature forming units 33, the row of teeth 34 may be driven by the active curvature forming unit 32 (when it is driven by an external force) to move along the moveable framework 31 and hence the row of teeth 34 may drive the two passive curvature forming units 33.

Figure 14:
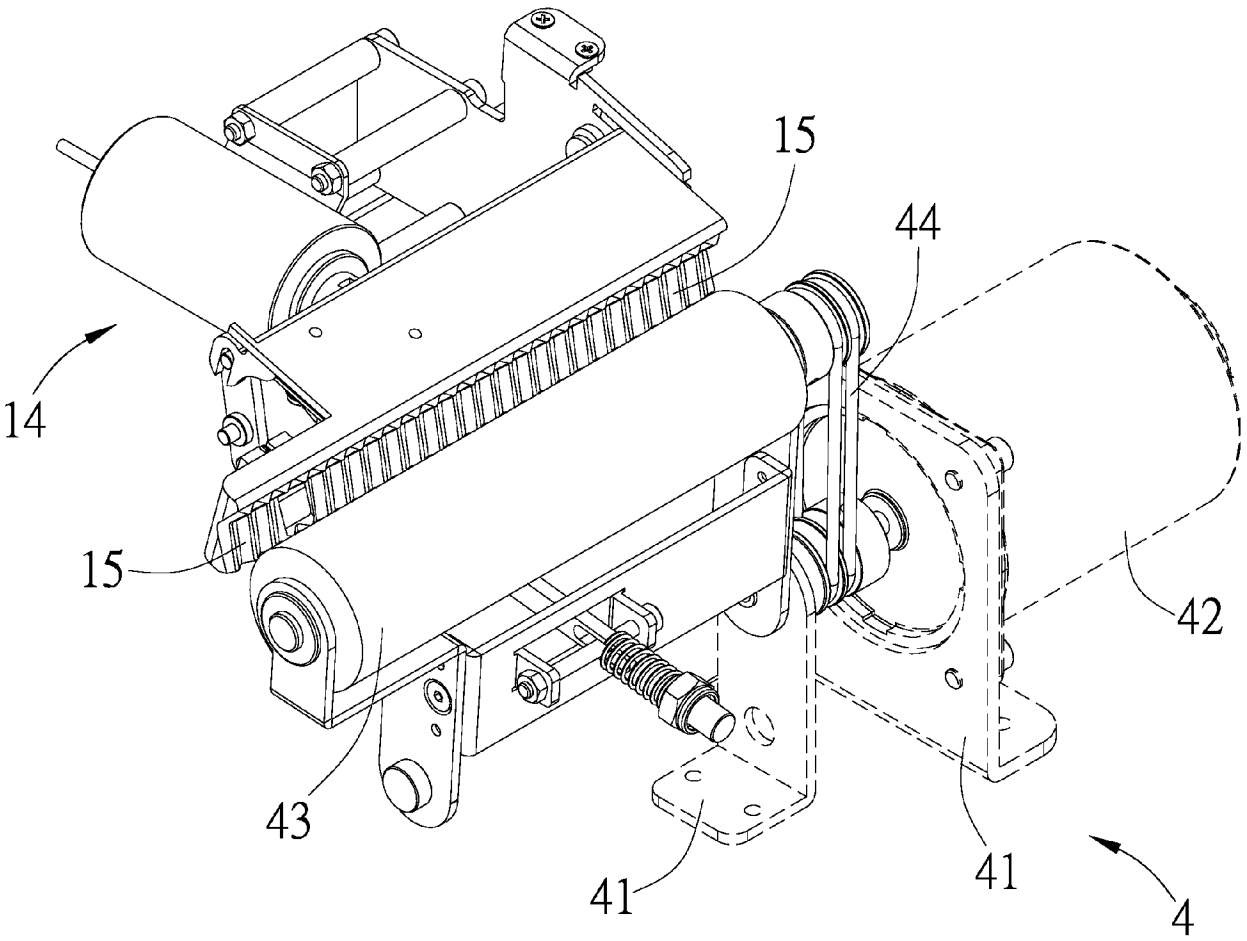
FIG. 14 is a perspective view showing the width adjusting device and the coil driving device.

Now, please refer to FIG. 14. The coil driving device 4 is disposed behind the coil guiding slot 11 and near the width adjusting device 14. The coil driving device 4 can move the coil 8 to enter the paper slot 27. The coil driving device 4 has a seating unit 41, a driving motor 42, a friction roller 43 and a transmission unit 44. The seating unit 41 is fixedly mounted in the main body 1. The driving motor 42 is disposed on the seating unit 41 and can drive the friction roller 43. The friction roller 43 is pivotally disposed on the seating unit 41 and may be driven to rotate. The transmission unit 44 links the driving motor 42 with the friction roller 43 to pass the rotational motion of the driving motor 42 to the friction roller 43. In this embodiment, the transmission unit 44 comprises two belts and two grooved axles.

Figure 15:
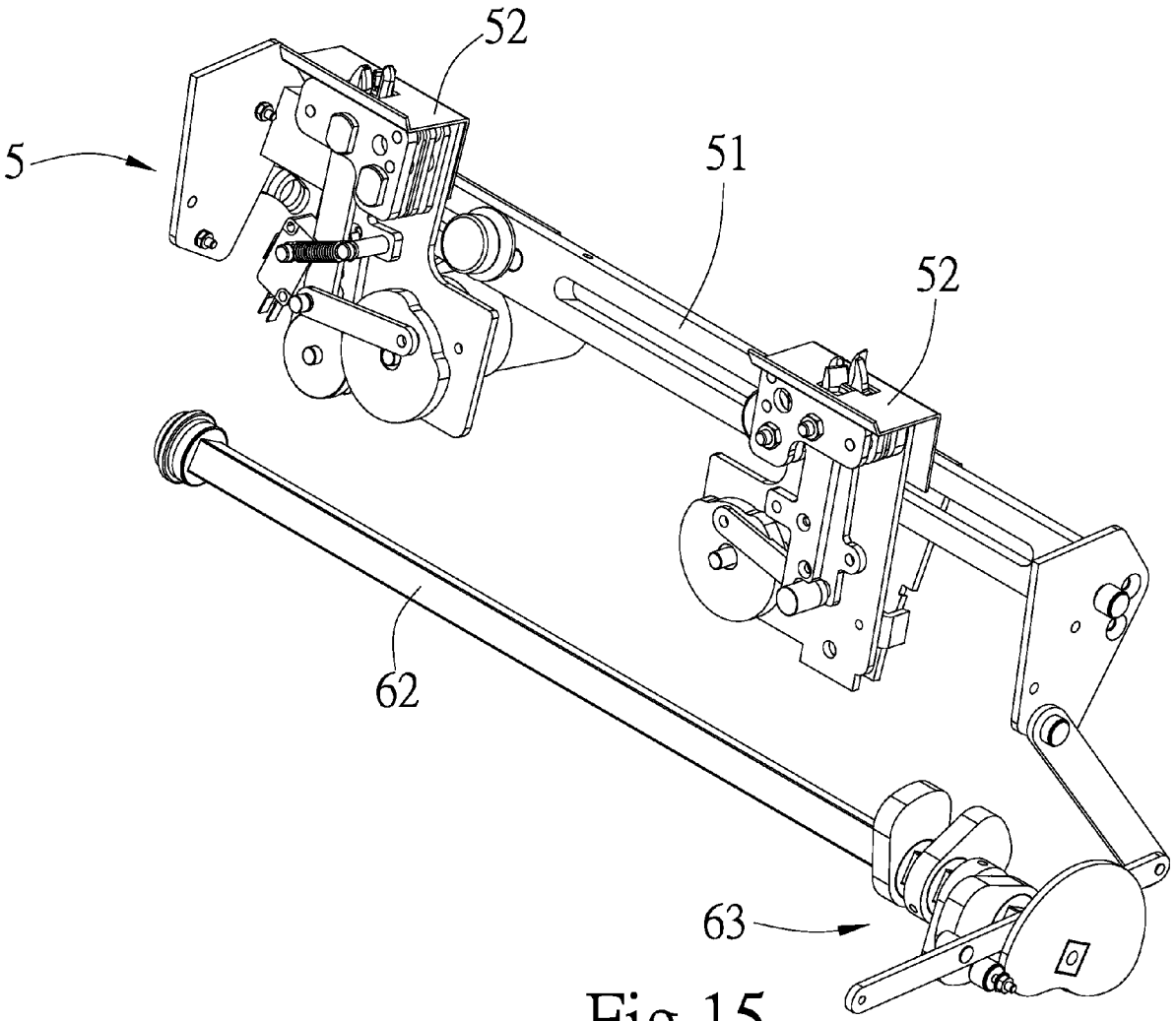
FIG. 15 is a perspective view showing the cutting device.
Figure 16A:
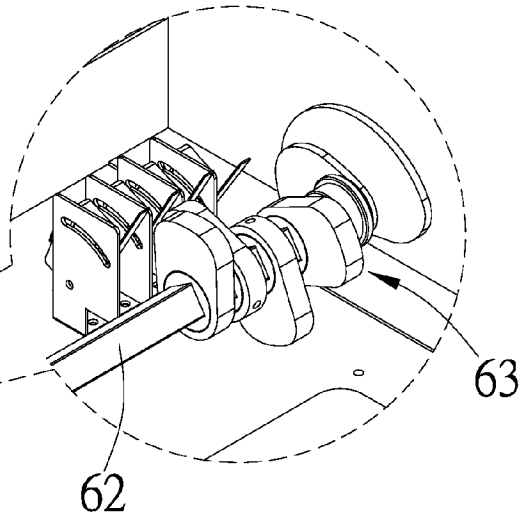
FIGS. 16 and 16A is a perspective view showing the driving device mounted on the main body and a partially enlarged view of FIG. 16.
Figure 16:
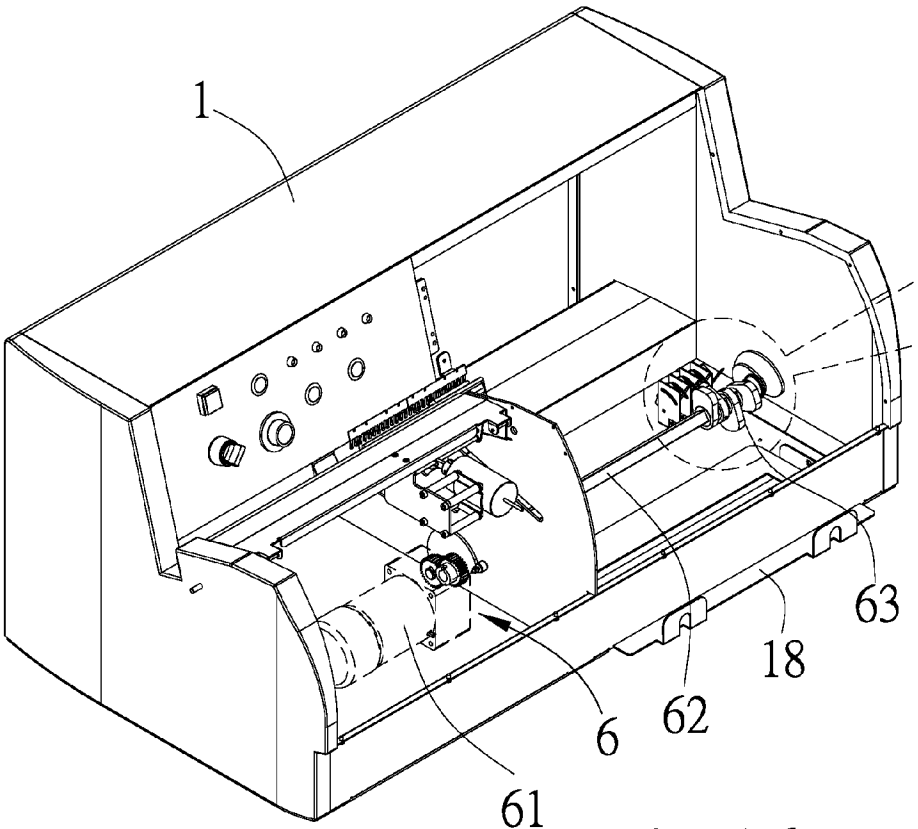

Now, please refer to FIGS. 15 and 16. The cutting device 5 is disposed under a rear portion of the guiding row of teeth 12. When the resting device 3 descends to the detachment position, the cutting device 5 would ascend to the resting device's resting position to cut up the two ends of the coil 8. The cutting device 5 has a moveable framework 51 and two cutting units 52, which may be driven by an external force. The moveable framework 51 is disposed inside the main body 1 and may be driven by an external force to reciprocally move between a cutting position and a preparatory position. The two cutting units 52 are mounted on the moveable framework 51 and may be driven by an external force to move along the moveable framework 51 to adjust the distance between them. In addition, the two cutting units 52 may be tilted at an angle with respect to the moveable framework 51.

The driving device 6 provides the driving force to the resting device 3 to reciprocally move between the resting position and the detachment position as well as the driving force to the cutting device 5 to reciprocally move between the cutting position and the preparatory position. The driving device 6 comprises a motor 61, an axle 62 and a plurality of cams 63. The motor 61 is disposed inside the main body 1 and can generate a driving force. The axle 62 is connected with the motor 61 and may receive the rotational motion from the motor. The cams 63 are mounted on the axle 62 and may receive the rotational motion from the axle 62. As illustrated in FIG. 2, the moveable framework 31 of the resting device 3 is linked up with one of the cams 63; while, the moveable framework 51 of the cutting device 5 is linked up with another cam 63; therefore, the driving force may be passed to the moveable framework 31 and the moveable framework 51.

Figure 17:
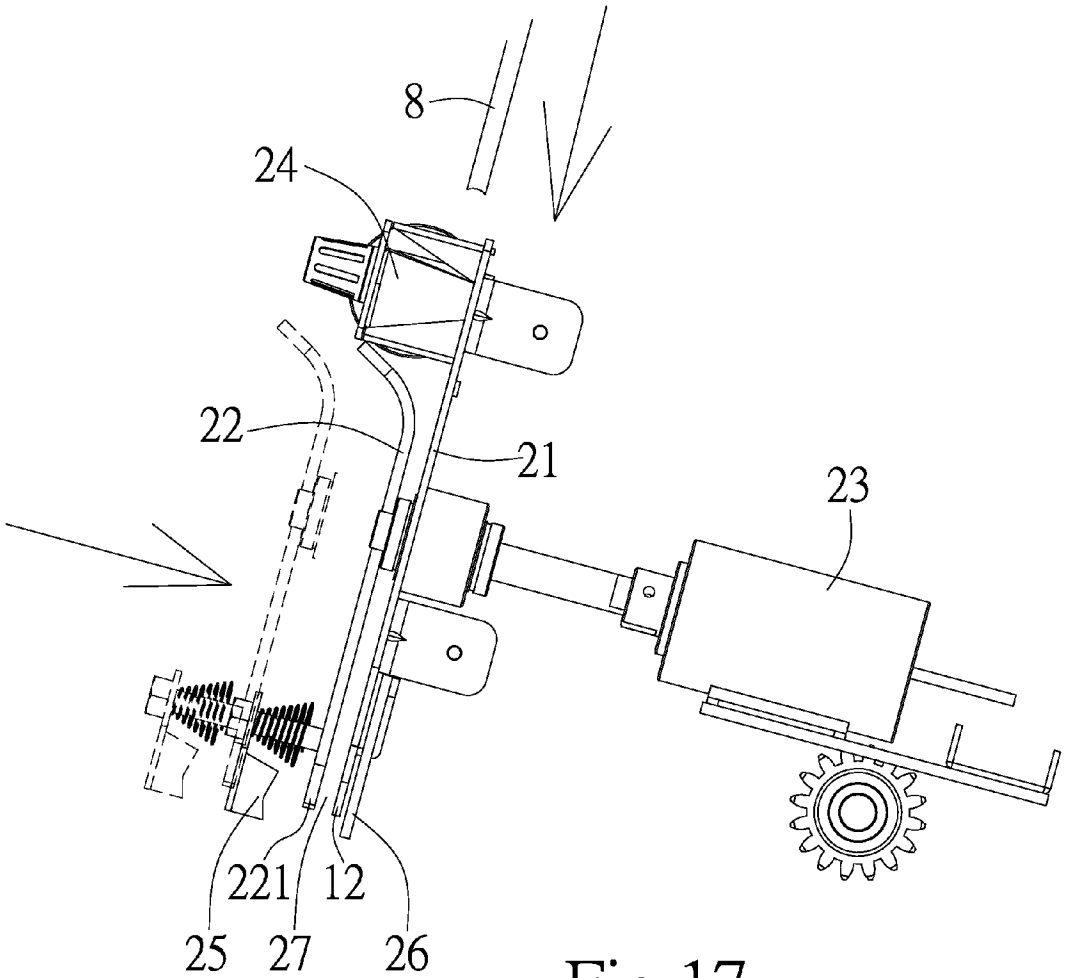
FIG. 17 is a side view showing a stack of paper punched with holes is being placed into the paper slot.
Figure 18A:
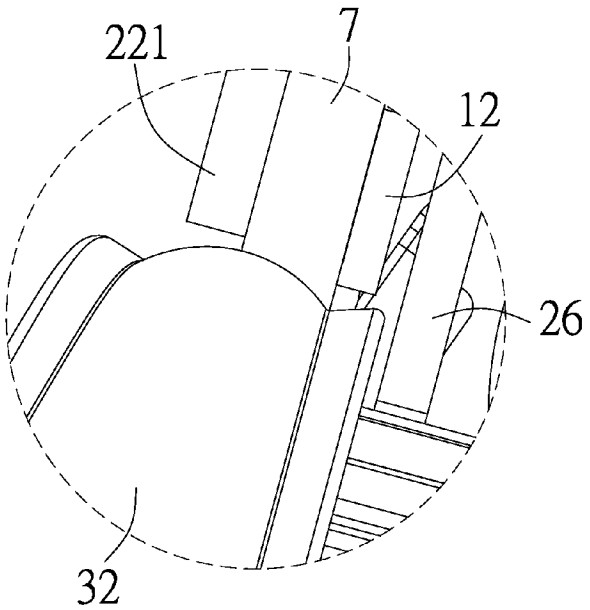
FIG. 18A is a partially enlarged view of part "A" in FIG. 18.
Figure 18:
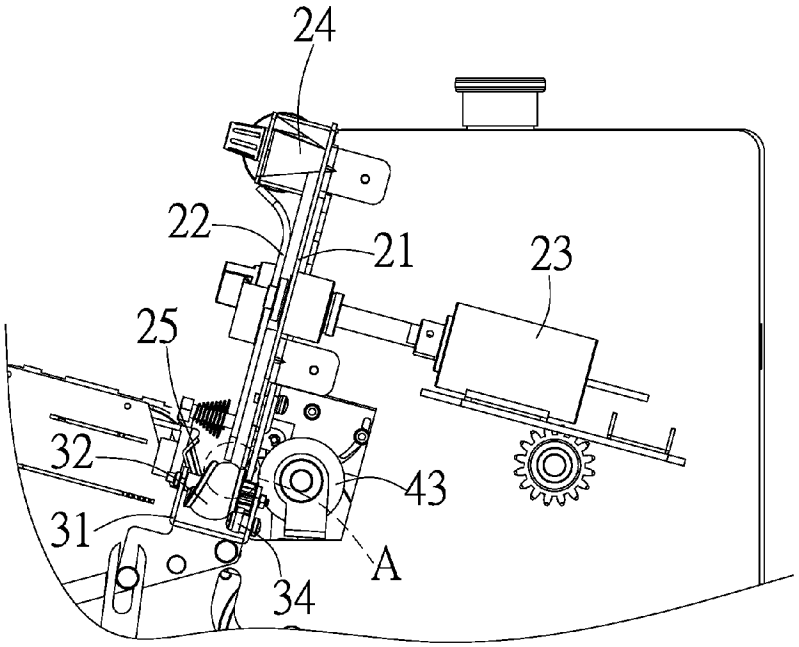
FIG. 18 is a side view showing the stack of paper is resting against the active curvature forming unit and the passive curvature forming unit.

The above is a detailed description of the components of the binding machine of the present invention. In use, first, a user should use the tilting angle adjusting knob 24 to adjust the tilting angle (as illustrated in FIG. 17) of the stack of paper 7 according to its thickness and then use the active curvature forming unit 32 to bend the binding edge (the passive curvature forming unit 33 will move with the active curvature forming unit 32) with a certain curvature. Therefore, after the stack of paper 7 is punched with holes and is placed in the paper slot 27, its binding edge may be tilted at a certain angle thanks to the tilting angle adjusting unit 24 and may be bent at a certain curvature thanks to the active curvature forming unit 32 and the passive curvature forming unit 33 (as illustrated in FIG. 18). Next, the user should adjust the position of the width adjusting device 14 relative to the guiding row of teeth 12 according to the diameter of the coil.

Figure 19:
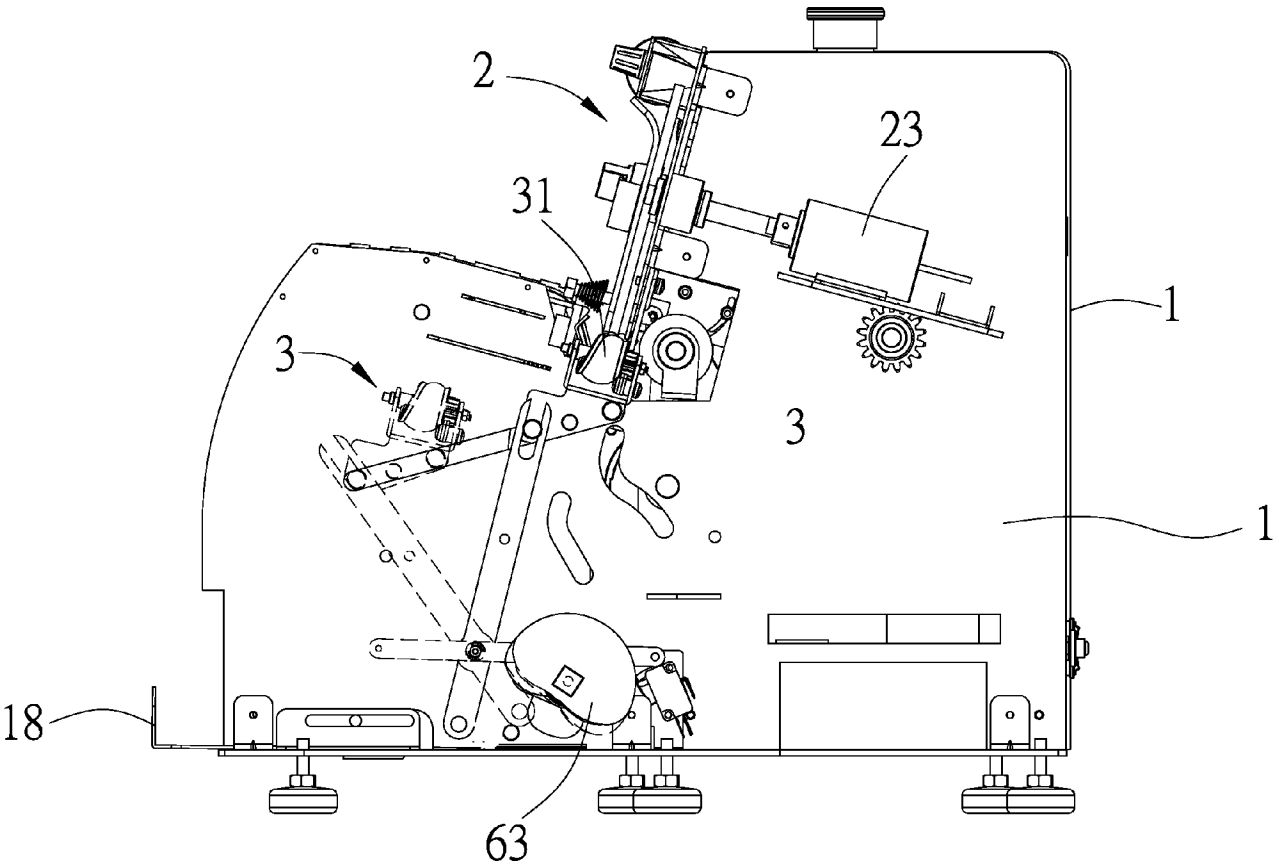
FIG. 19 is a side view showing the resting device of the binding machine goes from its resting position to its detachment position.
Figure 20:
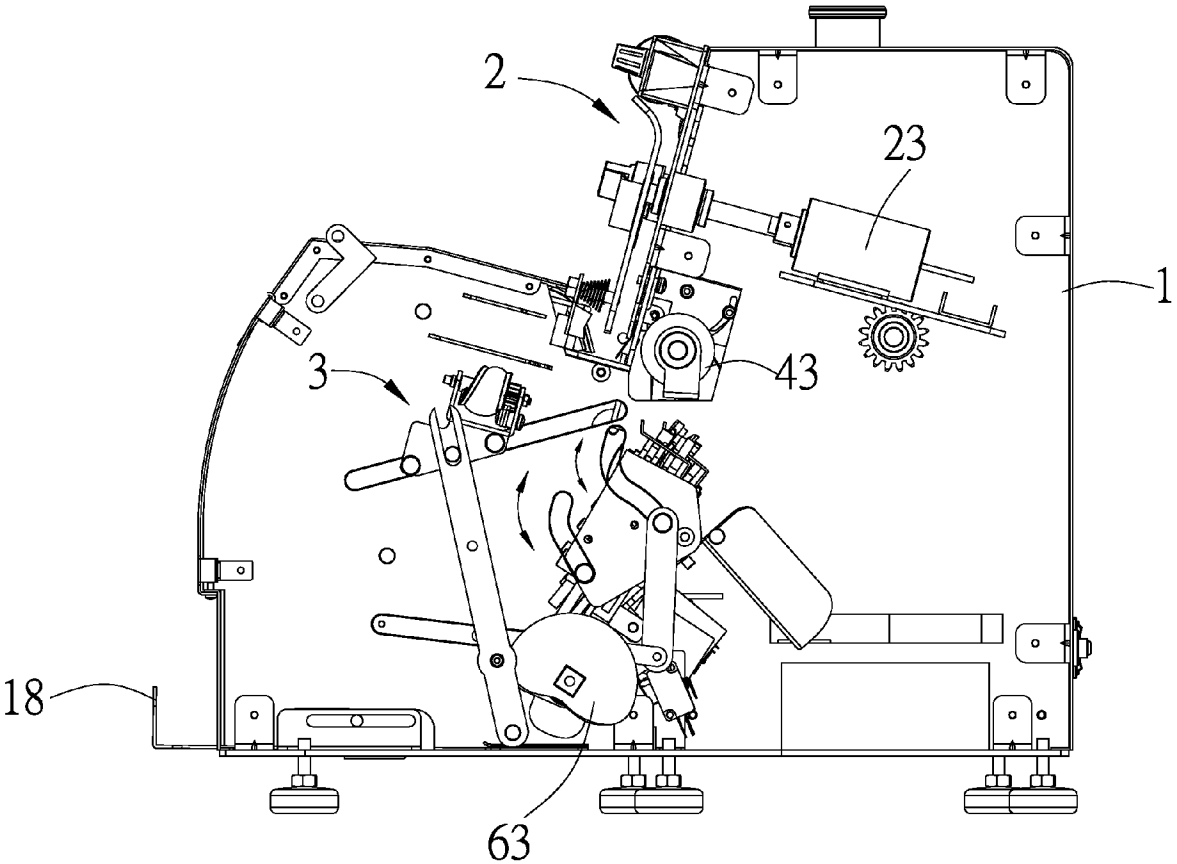
FIG. 20 is a side view showing the cutting device is moved by the driving device again to move from its preparatory position to its cutting position.

The user may then use the control panel 17 to carry out the binding process. After the stack of paper 7 is placed in the paper slot 27, a paper clamping motor 23 may be powered up to move the outer plate unit 22 to the paper clamping position so as to securely fix it in the paper slot 27. Next, as illustrated in FIG. 19, the moveable framework 31 is moved by the driving device 23 to the detachment position and hence the active curvature forming unit 32 and the passive curvature forming unit 33 may detach from the stack of paper 7. Next, the coil 8 positioned between the coil guiding slot 11 and the width adjusting device 14 is moved forward by the friction roller 43 and is moved along the bottom portion 111, guiding row of teeth and coil guiding unit 13 to spin through the holes. Then, the moveable framework 51 of the cutting device 5 is moved by the motor to move the cutting device to the cutting position (as illustrated in FIG. 20). Now, the two cutting units 52 cut up the coil at the two ends.

Then, the cutting device 5 is moved by the driving device again to move from its cutting position to its preparatory position. Next, the paper clamping motor of the paper clamping device 2 moves the outer plate unit 22 from the clamping position to the detachment position to allow the bound book in the paper slot 27 to go through the opening of the collecting plate unit 18 to reach the underside of the main body. If necessary, the user may pull out the collecting plate unit 18 so that the bound book may move through the collecting plate unit 18 to be collected outside the main body 1. The aforesaid procedure may be repeated to bind many stacks of paper 7 into books. Therefore, through the use of this binding machine, the goals of mass production, higher efficiency in book binding process and the saving of time and manpower may be achieved.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A fully automatic coil binding machine, comprising:

a main body, having a coil guiding slot and a guiding row of teeth provided in the slot;

a width adjusting device, disposed by the coil guiding slot and able to be driven to move reciprocally to adjust the width of the coil guiding slot;

a paper clamping device, disposed on the right hand side of the main body and having an inner plate unit, an outer plate unit, at least a paper clamping motor and a tilting angle adjusting unit, wherein the inner plate unit is fixed on the main body and the outer plate unit is disposed on an outer side with respect to the inner plate unit and is connected with a paper clamping motor, so that the former moves in sync with the latter, characterized in that the outer plate unit may be moved reciprocally between a paper clamping position and a paper releasing position, that when the outer plate unit is at the paper releasing position, a paper slot, which is aligned with and in communication with the coil guiding slot, is formed between the outer plate unit and the inner plate unit, so that a stack of paper may be held in the paper slot, and characterized in that a tilting angle adjusting unit is disposed on a side of the paper slot to adjust the tilting angle of the stack of paper;

a resting device, disposed inside the main body and may be driven to reciprocally move between a resting position and a detachment position, characterized in that when the resting device is at the resting position, the stack of paper placed in the paper slot may rest against the resting device, so as to form a curvature on the binding edge of the stack of paper;

a coil driving device, disposed behind the coil guiding slot and near the width adjusting device and able to move the coil along the guiding row of teeth to enter the paper slot, so that the coil may spin through the punched holes of the stack of paper; and a cutting device, disposed on the main body and may be driven by an external force to reciprocally move between a cutting position and a preparatory position, characterized in that when the cutting device is at its cutting position, it may cut up the two ends of the coil, wherein the resting device has a moveable framework, an active curvature forming unit, two passive curvature forming units and a row of teeth, and wherein the moveable framework is disposed inside the main body and may be driven to reciprocally move between a resting position and a detachment position, and wherein the active curvature forming unit and the two passive curvature forming units are pivotally mounted on the moveable framework and the two passive curvature forming units are disposed on the two sides of the active curvature forming unit with a predetermined spacing from the latter, and wherein the row of teeth is mounted on the moveable framework and able to move along the latter, characterized in that because the row of teeth engages with the active curvature forming unit and two passive curvature forming units, the row of teeth may be driven by the active curvature forming unit (when it is driven by an external force) to move along the moveable framework and hence the row of teeth may drive the two passive curvature forming units, so as to form a curvature on the binding edge of the stack of paper.

2. The fully automatic coil binding machine as in claim 1, wherein the coil driving device has a seating unit, a driving motor, a friction roller and a transmission unit, and wherein the seating unit is fixedly mounted in the main body and the driving motor is disposed on the seating unit and can drive the friction roller, and wherein the friction roller is pivotally disposed on the seating unit and may be driven to rotate, and wherein the transmission unit links the driving motor with the friction roller to pass the rotational motion of the driving motor to the friction roller, so that the coil may be fed to the coil guiding slot.

* * * * *